US009950328B2

(12) United States Patent
Vellaiah Retnaswamy

(10) Patent No.: US 9,950,328 B2
(45) Date of Patent: Apr. 24, 2018

(54) APPARATUS FOR DISPERSING PARTICLES IN A FLUID

(71) Applicant: ALFA LAVAL CORPORATE AB, Lund (SE)

(72) Inventor: Ashok Vellaiah Retnaswamy, Humble, TX (US)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 15/078,551

(22) Filed: Mar. 23, 2016

(65) Prior Publication Data

US 2017/0274398 A1 Sep. 28, 2017

(51) Int. Cl.

*B05B 7/04* (2006.01)
*B01F 5/08* (2006.01)
(Continued)

(52) U.S. Cl.

CPC ..... *B05B 7/1404* (2013.01); *B01F 5/0256* (2013.01); *B01F 5/064* (2013.01); *B01F 5/08* (2013.01); *B01F 13/1016* (2013.01); *B01F 15/00344* (2013.01); *B01F 15/00357* (2013.01); *B05B 1/02* (2013.01); *B01F 3/04049* (2013.01); *B05B 1/042* (2013.01); *B05B 1/202* (2013.01); *B05B 7/04* (2013.01); *B05B 7/0408* (2013.01)

(58) Field of Classification Search

CPC ..... B05B 1/202; B05B 7/04; B05B 7/0408; B01F 5/0256; B01F 3/04049; B01F 5/064; B01F 5/08; B01F 13/1016; B01F 15/00344; B01F 15/00357

USPC ..... 239/439–440, 433–434, 543–545; 137/599.12

See application file for complete search history.

(56) References Cited

U.S. PATENT DOCUMENTS 2,235,258 A * 3/1941 Jones ..... B05B 1/14 169/37
2,719,704 A * 10/1955 Anderson ..... A47L 15/4427 137/599.03
(Continued)

FOREIGN PATENT DOCUMENTS

DE 1 689 819 12/1954
DE 36 19 857 C2 1/1988
(Continued)

OTHER PUBLICATIONS

Communication dated Jun. 13, 2017 issued by the European Patent Office in corresponding International Application No. PCT/EP2017/055698 (14 pages).

*Primary Examiner* — Darren W Gorman
*Assistant Examiner* — Joseph A Greenlund
(74) *Attorney, Agent, or Firm* — Buchanan Ingersoll & Rooney PC

(57) ABSTRACT

An apparatus for dispersing particles in a fluid, comprising: a flow divider for receiving the fluid and for separating the fluid into a first fluid stream and a second fluid stream; first and second fluid branches for receiving the fluid streams; a branch joining section for receiving the fluid streams, the branch joining section having a collision zone for allowing the first and second fluid streams to collide; a first nozzle that is arranged in the first fluid branch; and a second nozzle is arranged in the second fluid branch, the first nozzle comprising an orifice that is followed by a fluid diverging section.

17 Claims, 2 Drawing Sheets

(51) Int. Cl.

| | |
|---|---|
| ***B05B 7/14*** | (2006.01) |
| ***B05B 1/02*** | (2006.01) |
| ***B01F 5/02*** | (2006.01) |
| ***B01F 5/06*** | (2006.01) |
| ***B01F 13/10*** | (2006.01) |
| ***B01F 15/00*** | (2006.01) |
| *B05B 1/04* | (2006.01) |
| *B05B 1/20* | (2006.01) |
| *B01F 3/04* | (2006.01) |

(56) References Cited

U.S. PATENT DOCUMENTS 2,770,501 A * 11/1956 Coanda ..... B01F 3/04049 239/429
2,785,926 A * 3/1957 Lataste ..... B05B 1/06 239/438
2,965,312 A * 12/1960 Hale ..... B05B 7/1481 239/119
3,272,441 A * 9/1966 Davis, Sr. ..... F23D 11/10 239/403
3,833,718 A * 9/1974 Reed et al. ..... C01F 7/34 166/292
3,840,183 A * 10/1974 Kuribayashi ..... B01F 3/04049 239/305
3,849,057 A * 11/1974 Peck ..... B05B 7/205 239/336
4,324,365 A * 4/1982 Howarth ..... B05B 7/045 239/424
4,783,008 A * 11/1988 Ikeuchi ..... B05B 7/064 239/421
5,080,286 A * 1/1992 Morrison ..... B05B 1/323 239/533.13
5,664,733 A * 9/1997 Lott ..... B01F 5/02 239/429
5,676,173 A * 10/1997 Conrad ..... G05D 11/006 137/599.03
5,810,252 A * 9/1998 Pennamen ..... B05B 7/0441 239/423
5,890,661 A * 4/1999 Crampton ..... B05B 1/26 239/333
5,927,852 A * 7/1999 Serafin ..... B01F 5/0644 366/144
5,964,418 A * 10/1999 Scarpa ..... B05B 7/1495 239/424
6,076,750 A * 6/2000 Mykkanen ..... B65B 39/00 141/311 A
6,088,934 A * 7/2000 Newton ..... B01J 8/1827 110/348
6,113,013 A * 9/2000 Sand ..... B05B 7/0846 239/543
6,234,664 B1 * 5/2001 Tromley ..... B01F 5/0256 366/136
6,313,717 B1 * 11/2001 Dufilie ..... H03H 9/0028 29/25.35
6,322,008 B1 * 11/2001 Aker ..... B05B 1/26 239/543
6,458,471 B2 * 10/2002 Lovato ..... E21B 10/5735 175/426
6,502,767 B2 * 1/2003 Kay ..... B05B 7/1486 239/433
6,721,466 B2 * 4/2004 Taylor ..... G02F 1/0134 385/11
6,722,584 B2 * 4/2004 Kay ..... B05B 7/1486 239/433
6,730,214 B2 * 5/2004 Mazzei ..... B01D 19/0068 210/188
6,814,150 B2 11/2004 Clauss et al.
7,219,849 B1 * 5/2007 Hedger ..... B05B 1/26 239/543
7,621,463 B2 * 11/2009 Presz, Jr. ..... B05B 1/341 239/101
7,651,621 B2 * 1/2010 Kelsey ..... B01D 19/0005 210/739
7,926,502 B1 * 4/2011 Lott ..... B01F 3/12 137/15.04
8,013,215 B2 * 9/2011 Damude ..... A23D 9/00 426/629
8,016,215 B1 * 9/2011 Zhadanov ..... B05B 15/066 239/536
8,313,717 B2 * 11/2012 Boe ..... B05B 1/08 239/433
8,408,479 B2 * 4/2013 Di Loreto ..... C23C 24/04 239/379
8,596,857 B2 * 12/2013 Bastesen ..... B01F 3/12 366/136
9,168,498 B2 10/2015 Muller et al.
9,242,260 B2 * 1/2016 Stevenson ..... B05B 7/30
2005/0161532 A1 * 7/2005 Steenkiste ..... B05B 7/1486 239/433
2007/0057083 A1 * 3/2007 Bolz ..... B05B 7/0012 239/34
2008/0048048 A1 * 2/2008 Noestheden ..... B05B 1/12 239/101
2010/0258654 A1 * 10/2010 Peterson ..... B05B 15/065 239/557
2011/0277379 A1 11/2011 Bortkevitch et al.
2013/0068852 A1 * 3/2013 Wurz ..... B01F 3/04049 239/8
2013/0294189 A1 * 11/2013 Myrick ..... B01F 3/0446 366/162.4
2015/0366127 A1 * 12/2015 Roberge ..... A01M 7/00 239/8

FOREIGN PATENT DOCUMENTS

| | | |
|---|---|---|
| DE | 19536845 A1 | 4/1997 |
| DE | 20306915 U1 | 8/2003 |
| GB | 543 995 | 3/1942 |
| GB | 949954 | 2/1964 |
| WO | WO 96/14941 A1 | 5/1996 |
| WO | WO 2008/058548 A1 | 5/2008 |

* cited by examiner

APPARATUS FOR DISPERSING PARTICLES IN A FLUID

TECHNICAL FIELD

The invention relates to an apparatus for dispersing particles in a fluid, where a flow divider separates fluid with particles into two fluid streams that are allowed to collide in a collision zone of the apparatus. A method for dispersing particles in a fluid is also described.

BACKGROUND ART

In a number of industries there is a need of mixing particles into fluids. This includes industries such as dairy, food, cosmetic, beverage, pharmaceutical, chemical, plastic, building construction, pulp and paper, oil and gas industries. The purpose of the mixing is to achieve e.g. homogenization, particle size reduction and dispersion of particles in the fluid. A number of technologies for obtaining adequate mixing are used, including rotating shear units, conventional stirring techniques, vibration based techniques, techniques were fluid streams collide etc. The mixing is performed in one or more stages and is typically effect in one or more shearing zones where fluid undergoes "shear", which happens when fluid travels with a different velocity relative to an adjacent area or fluid volume.

One example of a mixer type is shown in patent document U.S. Pat. No. 3,833,718 which describes a so called jet mixer. This mixer is used for providing high shear mixing of fluids such as in the preparation of slurry solutions for well treating. The mixing principle is based on forming a shear zone at the confluence of opposing streams of a mixture of fluid and particles. The mixer is based on separating the fluid into two streams and then directing the streams towards each other and jetting the two opposing streams in a mixing zone to form a shear zone at the confluence of the merging streams. The streams are directed into the mixing zone from a location substantially at right angles to each other, which effectively accomplishes mixing (shearing).

The described mixer seems to provide adequate mixing. However, it is estimated that a mixer of this type may be improved, for example in respect of its capability to effectively mix particles at a wider range of flow rates of the fluid. Also, it is desirable that the described type of mixer should be able to efficiently mix a greater variety of fluid types and particle types.

SUMMARY

It is an object of the invention to at least partly improve the above-identified prior art. Another object may be to obtain proper mixing for a great variety of fluid types and particle types.

To solve these objects an apparatus for dispersing particles in a fluid is provided. The apparatus comprises: a flow divider for receiving the fluid and for separating the fluid into a first fluid stream and a second fluid stream; a first fluid branch for receiving the first fluid stream; a second fluid branch for receiving the second fluid stream; and a branch joining section for receiving the first and second fluid streams from the first and second fluid branches, the branch joining section having a collision zone for allowing the first and second fluid streams to collide. A first nozzle is arranged in the first fluid branch and a second nozzle is arranged in the second fluid branch, the first nozzle comprising an orifice that is followed by a fluid diverging section. The second nozzle may be identical to the first nozzle, even though it is possible to use different nozzles. The diverging section may have a linear divergence, a curved divergence or another shape for the divergence. The diverging section is advantageous in that it gives a relation between a fluid velocity and a pressure drop that appears to improve the dispersing of particles in the fluid.

According to another aspect a method of dispersing particles in a fluid is also provided. The method comprises: introducing fluid with particles in an inlet of an apparatus that comprises: a flow divider for receiving the fluid and for separating the fluid into a first fluid stream and a second fluid stream; a first fluid branch for receiving the first fluid stream; a second fluid branch for receiving the second fluid stream; a branch joining section for receiving the first and second fluid streams from the first and second fluid branches, the branch joining section having a collision zone for allowing the first and second fluid streams to collide and thereafter flow towards an outlet; wherein a first nozzle is arranged in the first fluid branch and a second nozzle is arranged in the second fluid branch, the first nozzle comprising an orifice that is followed by a fluid diverging section. The method comprises measuring a differential pressure over the inlet and the outlet of the apparatus, and adjusting, in dependence of the measured differential pressure, a flow rate of the fluid with the particles that are introduced in the inlet.

The apparatus may include a number of different features as described below, alone or in combination. The apparatus that is used in the method may include the same features. Objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
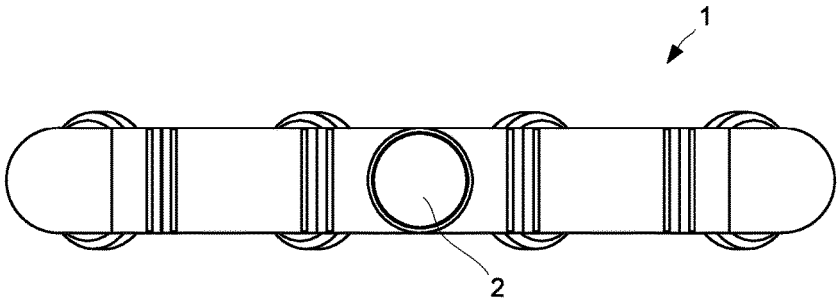
FIG. 1 is a rear view of an apparatus for dispersing particles in a fluid.
Figure 2:
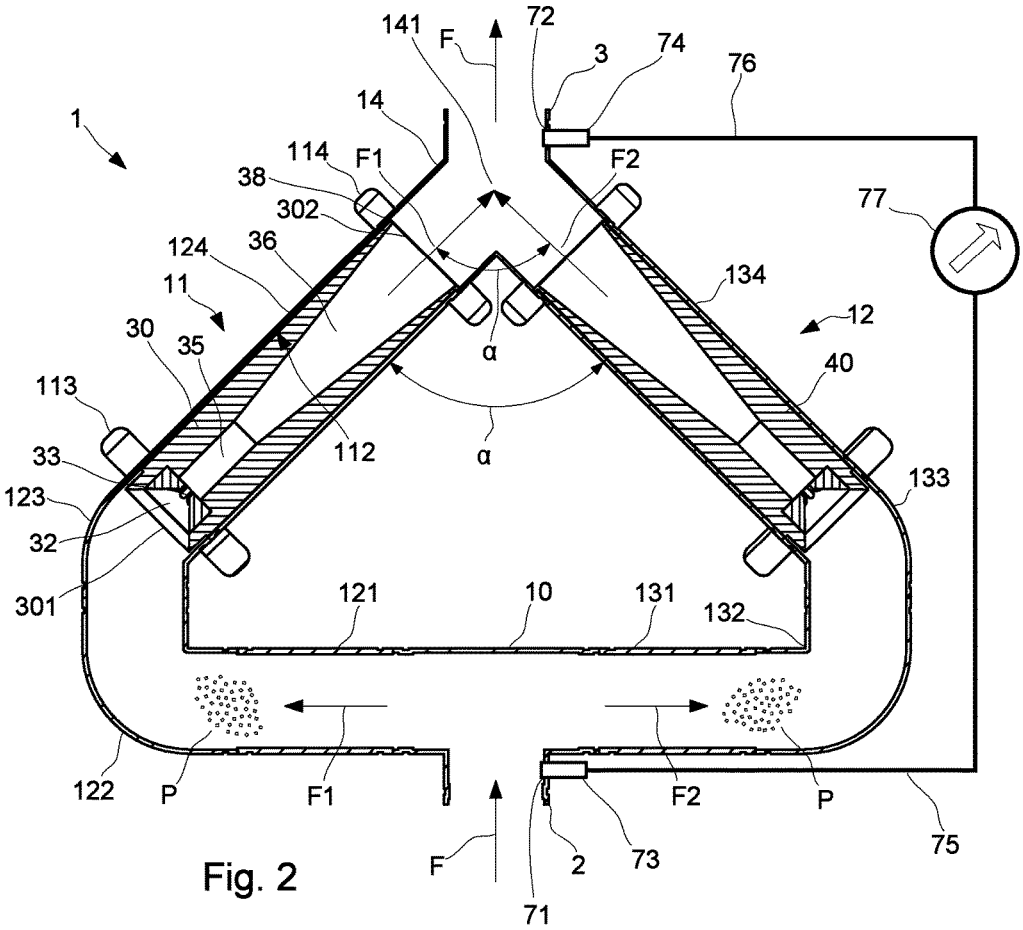
FIG. 2 is a cross-sectional top view of the apparatus if FIG. 1.
Figure 3:
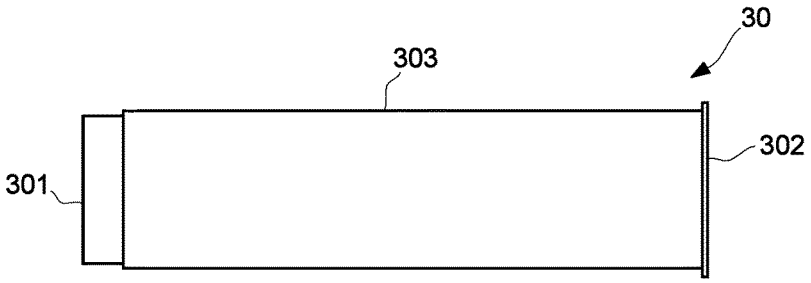
FIG. 3 is a side view of a nozzle that is arranged in the apparatus of FIG. 1.
Figure 4:
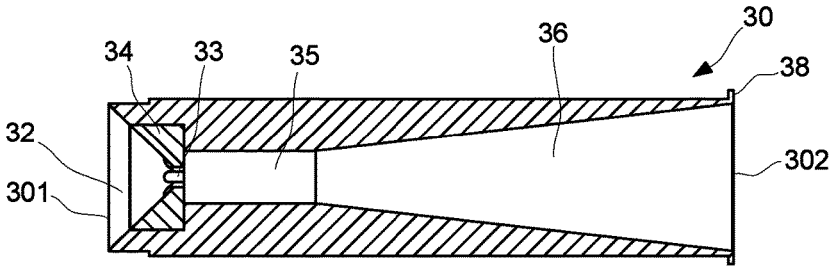
FIG. 4 is a cross-sectional side view of the nozzle of FIG. 3.

With reference to FIGS. 1 and 2 an apparatus 1 for dispersing particles P in a fluid F is illustrated. The apparatus 1 has the principal form of a triangular piping component, with an inlet 2 at a center of the base of the triangle, and with an outlet 3 at the top of the triangle. The fluid F includes the particles P when it enters the inlet 2 and when the fluid F is inside the apparatus 1, then the particles P are dispersed in the fluid F, as will be described in detail below, before the fluid F leaves the apparatus 1 via the outlet 3. The particles P may to some extent be dispersed in the fluid F when it enters the apparatus 1. After the fluid F has passed though the apparatus 1 then the particles are much more, or even fully, dispersed in the fluid F.

In detail, the apparatus 1 comprises a flow divider 10 in form of a t-section pipe where the inlet 2 is the base of the flow divider 10. From the inlet 2 the flow divider 10 separates the fluid F into a first fluid stream F1 and a second fluid stream F2. The apparatus 1 has a first fluid branch 11 that is connected to the flow divider 10 for receiving the first fluid stream F1. A second fluid branch 12 is connected to the flow divider 10, on a side that is opposite the side where the first fluid branch 11 is connected. The second fluid branch 12 receives the second fluid stream F2.

The first fluid branch 11 comprises a straight section 121 that is connected to the flow divider 10, a 90° pipe elbow 122 that is connected to the straight section 121, an angled elbow 123 that is connected to the pipe elbow 122, and a second straight section 124 that is connected to the angled elbow 123. The angled elbow 123 is angled by half the angle α.

The second fluid branch 12 comprises a straight section 131 that is connected to the flow divider 10, at an opposite side of the flow divider 10 from where the straight section 121 of the first fluid branch 11 is connected. The second fluid branch 12 is similar to the first fluid branch 11 and has a 90° pipe elbow 132 that is connected to the straight section 131, an angled elbow 133 that is connected to the pipe elbow 132, and a second straight section 134 that is connected to the angled elbow 133. The angled elbow 133 is angled by half the angle α.

The second straight sections 124, 134 of the first fluid branch 11 and the second fluid branch 12 are connected to a branch joining section 14 that receives the first and second fluid streams F1, F2 from the first and second fluid branches 11, 12. The branch joining section 14 has the shape of a y-section pipe. The branch joining section 14 comprises the outlet 3 and the branch joining section 14 has an internal collision zone 141 where the first fluid stream F1 and the second fluid stream F2 meet and collide. When the fluid streams F1, F2 collide they undergo shear since the streams F1, F2 travel with a different velocity relative each other when they meet in the collision zone 141. Generally the velocities of the fluid streams F1, F2 are the same in terms of flow rate, but they have different directions which effects the shear. The collision zone 141 may also be referred to as a shearing zone.

The parts of the two fluid branches 11, 12 are typically made of metal, such as steel, and may be joined to each other by welding. However, the second straight sections 124, 134 of the two fluid branches 11, 12 are typically joined to their respective adjacent parts by two conventional clamps. For example, a first clamp 113 joins a first end of the second straight section 124 of the first fluid branch 11 to the angled elbow 123. A second clamp 114 joins the other end of the second straight section 124 of the first fluid branch 11 to the branch joining section 14. Two similar clamps join the second straight section 134 of the second fluid branch 12 in a similar manner to its adjacent angled elbow 133 and to the branch joining section 14. The clamps may have the form of any conventional clamps that are suitable for joining pipe components, and the sections 123, 124, 14, 134, 133 that are joined by the clamps are fitted with conventional flanges that are compatible with the clamp. By virtue of the clamps, it is possible for an operator to remove the second straight sections 124, 134 of the first and second fluid branches 11, 12.

The first fluid branch 11 and the second fluid branch 12 are arranged to direct the first fluid stream F1 and the second fluid stream F2 towards each other by an angle α of 60°-120°. As a result the first fluid stream F1 and the second fluid stream F2 meet in the collision zone 141 by the same angle α of 60°-120°. The collision angle α between the fluid streams F1, F2 is accomplished by angling each of the angled elbows 123, 133 by half the angle α.

A first nozzle 30 is arranged in the first fluid branch 11 and a second nozzle 40 is arranged in the second fluid branch 12. The second nozzle 40 may incorporate the same features as the first nozzle 30, such that they are similar, or even identical. Thus, every feature that is described for the first nozzle 30 may also be implemented for the second nozzle 40. Each of the nozzles 30, 40 is removable from the fluid branch 11, 12 they are located in. This is accomplished by releasing the clamps from the second straight sections 124, 134. The nozzles are located in the second straight sections 124, 134 and by taking the nozzle out from removed straight section, the nozzles may be replaced.

The first nozzle 30 has an orifice 33 that is followed by a fluid diverging section 36. The diverging section 36 may have a linear divergence, a curved divergence, a combination thereof or another shape for the divergence. The diverging section 36 may also have a step wise divergence. In this context "diverging section" may be understood as a section with a cross-sectional area that increases in a direction of a flow of the fluid (the direction of the first fluid stream F1). A linear divergence or a slightly curved divergence is preferred, since this gives an advantageous relation between a fluid velocity and a pressure drop when the fluid passes through the first nozzle 30.

With further reference to Figs outlet 3-7, the first nozzle 30 has an inlet 301 into which the first fluid stream F1 flows, and an outlet 302 from which the first fluid stream F1 leaves the first nozzle 30. As may be seen in FIG. 2, the first clamp 113 is located at a position of the first fluid branch 11 where the inlet 301 of the of the first nozzle 30 is located. The second clamp 114 is located at a position of the first fluid branch 11 where the outlet 302 of the of the first nozzle 30 is located. The first nozzle 30 has an outer elongated, cylindrical surface 303. This cylindrical surface 303 abuts an inner surface 112 of the first fluid branch 11, when the first nozzle 30 is located in the first fluid branch 11. More specifically, the inner surface 112 of the first fluid branch 11 is an inner surface of a straight pipe component 124 that is part of the first fluid branch 11.

The first nozzle 30 has an intermediate flow section 35 that is located between the orifice 33 and the fluid diverging section 36. The intermediate flow section 35 has a constant cross-sectional area. The first nozzle 30 has a fluid converging section 32 that converges towards the orifice 33. Thus, the fluid converging section 32 is located, as seen in a direction of a flow of the first fluid stream F1, before the orifice 33. The fluid converging section 32 has a cross-sectional area that decreases in a direction towards the orifice 33. The converging section 32 may have a linear convergence or a curved convergence, or a combination thereof.

Figure 5:
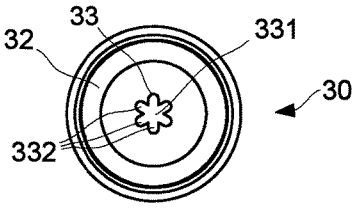
FIG. 5 is a front view of the nozzle of FIG. 3.
Figure 6:
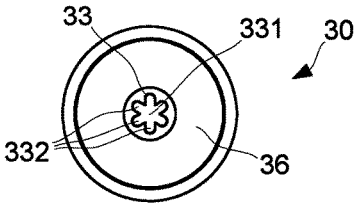
FIG. 6 is a rear view of the nozzle of FIG. 3.
Figure 7:
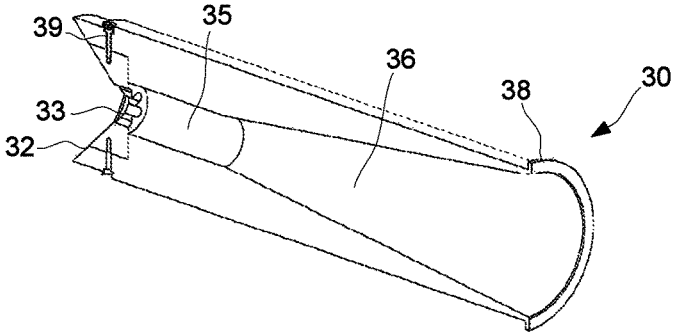
FIG. 7 is a cross-sectional perspective view of the nozzle of FIG. 3.

As may be seen on FIGS. 5 and 6, the orifice 33 has a central region 331 and a plurality of angularly spaced-apart, outer regions 332 around the periphery of the central region 331. The outer regions 332 provide, when a fluid flows through the outer regions 332, a vortex flow pattern that provides a shearing effect and thus improved dispersing of the particles in the first fluid stream F1. The orifice 33 is for the illustrated embodiment formed in an orifice component 34 that is arranged in the first nozzle 30. The orifice component 34 is fixed to the first nozzle 30 by a set of screws 39, and is removable from the first nozzle 30. This allows the orifice component 34 to be replaced by another orifice component. The orifice component 34 may be omitted in the sense that the orifice 33 may be made as an integral part of the first nozzle 30.

The first nozzle 30 comprises a circumferential flange 38 that abuts the first fluid branch 11. This fixes the first nozzle 30 relative the first fluid branch 11, as seen in a direction of a flow of the first fluid F1, i.e. in a direction along the first nozzle 30. Typically, the first nozzle 30 is made as one integral unit that includes the converging section 32, the orifice 33, the intermediate flow section 35 and the diverging section 36. The first nozzle 30 is typically made of plastic.

When the first fluid stream F1 flows through the first fluid branch 11 it enters the first nozzle 30 via the nozzle inlet 301, experiences an increased flow velocity as it passes through the converging section 32, is subjected to increased shear as it passes through the orifice 33, passes through the intermediate flow section 35, experiences a decreased flow velocity as it passes through the diverging section 36, and leaves the first nozzle 30 via the nozzle outlet 302. Both the converging section 32 and the diverging section 36 increases the shear of the fluid, which improves the dispersing of particles P in the fluid F. Corresponding situation applies for the second fluid stream F2 when passing through the second nozzle 40 in the second fluid branch 12. When the first fluid stream F1 and the second fluid stream F2 collide in the collision zone 141 then the fluid is subjected to further shear.

Turning again to FIG. 2, the apparatus 1 has at the inlet 2 a first pressure sensing interface 71 and has at the outlet 3 a second pressure sensing interface 72. The pressure sensing interfaces 71, 72 may have the form of openings to which pressure sensing devices are connected. A reason for connecting pressure sensing devices to the apparatus 1 is that the performance of the apparatus 1, i.e. its capability to effectively disperse particles P in the fluid F, depends on the differential pressure over the apparatus 1. The differential pressure over the apparatus 1 is the difference between the pressure at a position near the inlet 2 and a pressure at a position near the outlet 3. For example, if the pressure at the inlet 2 equals 100 psi and if the pressure at the outlet 3 equals 60 psi, then the differential pressure is 40 psi (100 psi-60 psi).

Thus, in order to measure the differential pressure the apparatus 1 has a pressure sensing device 77 for measuring the differential pressure over the apparatus 1 when the fluid F is flowing through the apparatus 1. The pressure sensing device 77 is a conventional differential pressure gauge and has a first pressure inlet port 73 and a second pressure inlet port 74 that are attached to the pressure sensing interfaces 71, 72, for example via two pressure conducting lines 75, 76. The differential pressure gauge performs the operation of pressure subtraction through mechanical means, which obviates the need for an operator or control system to determine the difference between the pressures at the pressure sensing interfaces 71, 72. Of course, any other suitable pressure sensing device may be used for determining the differential pressure.

During operation of the apparatus 1 the differential pressure in monitored and the flow rate of the fluid F is adjusted so as to obtain a predetermined differential pressure that is known to provide proper dispersion of the particles P in the fluid F. Exactly what the predetermined differential pressure should be may depend on a number of factors, such as the size of the apparatus 1, the type of the fluid F and the type of the particles, and is preferably empirically determined by adjusting the flow rate until the particle dispersion is satisfactory. The differential pressure that then can be read is then set as the predetermined differential pressure for the apparatus 1 and for the types of fluid F and particles P that were used.

The pressure sensing device 77 must not necessarily be a differential pressure gauge. The pressure sensing device 77 may also have the form of two conventional pressure meters that are connected to a respective pressure sensing interface 71, 72. These pressure meters then indicate, e.g. to an operator, the differential pressure over the apparatus since the operator may easily determine the differential pressure based on the readings form the pressure meters. It is also possible to indicate the differential pressure to a control system, for example by applying conventional electronic communication techniques. The control system can then adjust, in dependence of the measured pressure readings, i.e. in dependence of the differential pressure $\Delta p$, a flow of the fluid F with the particles P that are introduced in the inlet 2 of the apparatus 1.

Figure 8:
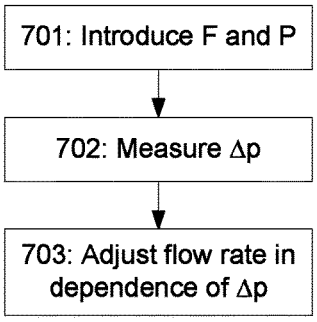
FIG. 8 is a schematic diagram of a method of dispersing particles in a fluid.

With reference to FIG. 8 a method of dispersing the particles P in the fluid F is illustrated. The method comprises introducing 701 the fluid F with particles P in the inlet 2 of the described apparatus 1, measuring 702 a differential pressure $\Delta p$ over the inlet 2 and the outlet 3 of the apparatus 1, and adjusting 703, in dependence of the measured differential pressure $\Delta p$, a flow of the fluid F with the particles P that are introduced in the inlet 2. The apparatus 1 that is used for the method is the same as described in connection with Figs apparatus 1-7. The adjustment 703 is performed until a predetermined differential pressure $\Delta p$ is obtained. In detail, the flow, or flow rate, of the fluid F with the particles P, may be adjusted 703 by changing the speed of a pump that feeds the fluid F with the particles P to the apparatus 1. A change in the pump speed changes the pressure at inlet of the apparatus 1, which in turn changes the flow (flow rate) of the fluid F with the particles P through the apparatus 1. The flow may also be adjusted 703 by e.g. throttling a valve that controls the flow of the fluid F with the particles P.

From the description above follows that, although various embodiments of the invention have been described and shown, the invention is not restricted thereto, but may also be embodied in other ways within the scope of the subject-matter defined in the following claims.

The invention claimed is:

1. An apparatus for dispersing particles in a fluid, comprising:

a flow divider for receiving the fluid with the particles and for separating the fluid with the particles into a first fluid stream with some of the particles and a second fluid stream with some of the particles, a first fluid branch for receiving the first fluid stream with some of the particles, a second fluid branch for receiving the second fluid stream with some of the particles, a branch joining section for receiving both the first fluid stream with the some of the particles from the first fluid branch and the second fluid stream with the some of the particles from the second fluid branch, the branch joining section having a collision zone at which the first and second fluid streams collide, a first nozzle arranged in the first fluid branch at a position between the flow divider and the branch joining section and a second nozzle arranged in the second fluid branch at a position between the flow divider and the branch joining section, the first nozzle comprising a first orifice followed by a first fluid diverging section, the first orifice and the first fluid diverging section increasing shear of the first fluid stream to improve dispersion of the some of the particles in the first fluid stream;

the second nozzle comprising a second orifice followed by a second fluid diverging section, the second orifice and the second fluid diverging section increasing shear of the second fluid stream to improve dispersion of the some of the particles in the second fluid stream; and an apparatus outlet though which the first and second fluid streams which have collided at the collision zone flow to exit the apparatus.

2. An apparatus according to claim 1, wherein the first nozzle comprises an intermediate flow section that is located between the first orifice and the first fluid diverging section, the intermediate flow section having a constant cross-sectional area.

3. An apparatus according to claim 1, wherein the first nozzle comprises a fluid converging section that converges towards the orifice.

4. An apparatus according to claim 1, wherein the first orifice comprises a central region and a plurality of angularly spaced-apart, outer regions around the periphery of the central region, so that a fluid flow through each of said outer regions develops a vortex flow pattern.

5. An apparatus according to claim 1, wherein the first nozzle is made of plastic and is arranged inside the first fluid branch.

6. An apparatus according to claim 1, wherein the first nozzle comprises a circumferential flange that abuts the first fluid branch so that the first nozzle is fixed relative the first fluid branch, as seen in a direction of a flow of the first fluid.

7. An apparatus according to claim 1, wherein the first fluid branch and the second fluid branch are positioned relative to each other to direct the first fluid stream and the second fluid stream towards each other at an angle of 60°-120°, so that the first and second fluid streams meet in the collision zone by said angle.

8. An apparatus according to claim 1, wherein the first nozzle comprises an outer elongated, cylindrical surface that abuts an inner surface of the first fluid branch.

9. An apparatus according to claim 1, wherein the first fluid branch comprises a first clamp that is located at a position of the first fluid branch where an inlet of the of the first nozzle is located, and a second clamp that is located at a position of the first fluid branch where an outlet of the of the first nozzle is located.

10. An apparatus according to claim 1, comprising a straight pipe section in which the first nozzle is located, the straight pipe section being attached to the apparatus by a first clamp and a second clamp.

11. An apparatus according to claim 1, comprising a first pressure sensing interface at an inlet of the apparatus and a second pressure sensing interface at the outlet of the apparatus.

12. An apparatus according to claim 1, comprising a pressure sensing device for indicating a differential pressure over the apparatus when the fluid is flowing through the apparatus.

13. An apparatus for dispersing particles in a fluid, comprising:

an apparatus inlet into which is introduced the fluid with particles;

a flow divider that receives the fluid with the particles introduced into the apparatus inlet and separates the fluid with the particles into a first fluid stream with some of the particles and a second fluid stream with some of the particles;

a first fluid branch that is connected to the flow divider and that receives the first fluid stream with the some of the particles;

a second fluid branch that is connected to the flow divider and that receives the second fluid stream with the some of the particles;

a first nozzle positioned in the first fluid branch and comprising a first nozzle inlet through which the first fluid stream with the some of the particles enters the nozzle and a first nozzle outlet through which the first fluid stream with the some of the particles exits the first nozzle, the first nozzle also comprising an orifice and a fluid diverging section that expands in size towards the first nozzle outlet;

a second nozzle positioned in the second fluid branch and comprising a second nozzle inlet through which the second fluid stream with the some of the particles enters the nozzle and a second nozzle outlet through which the second fluid stream with the some of the particles exits the second nozzle, the second nozzle also comprising an orifice and a fluid diverging section that expands in size towards the second nozzle outlet;

a branch joining section connected to the first fluid branch and the second fluid branch for receiving both the first fluid stream with the some of the particles and the second fluid stream with the some of the particles, the branch joining section including a collision zone at which the first fluid stream with the some of the particles and the second fluid stream with the some of the particles collide and are subjected to shearing to produce a sheared fluid stream in which the particles are dispersed;

an apparatus outlet through which the sheared fluid stream flows;

a first pressure sensing interface at the apparatus inlet that measures pressure at the apparatus inlet;

a second pressure sensing interface at the apparatus outlet that measures pressure at the apparatus outlet; and a control system receiving information identifying a pressure differential between the pressure measured at the apparatus inlet and the pressure measured at the apparatus outlet, and controlling a flow of the fluid with the particles introduced to the apparatus inlet based on the pressure differential so that pressure differential which produces a desired dispersion of the particles in the fluid is achieved.

14. The apparatus for dispersing particles in a fluid according to claim 13, wherein the second nozzle includes a fluid converging section that decreases in size away from second nozzle inlet, an intermediate flow section of constant size larger than a size of the orifice in the second nozzle, the intermediate flow section being positioned between the orifice of the second nozzle and the fluid diverging section of the second nozzle, the orifice of the second nozzle immediately following the fluid converging section of the second nozzle, the intermediate flow section of the second nozzle immediately following the orifice of the second nozzle, the fluid diverging section of the second nozzle immediately following the intermediate flow section of the second nozzle.

15. The apparatus for dispersing particles in a fluid according to claim 14, wherein the first nozzle includes a fluid converging section that decreases in size away from the first nozzle inlet, an intermediate flow section of constant size larger than a size of the orifice in the first nozzle, the intermediate flow section of the first nozzle being positioned between the orifice of the first nozzle and the fluid diverging section of the of the first nozzle, the orifice of the of the first nozzle immediately following the fluid converging section of the first nozzle, the intermediate flow section of the first nozzle immediately following the orifice of the first nozzle, the fluid diverging section of the first nozzle immediately following the intermediate flow section of the first nozzle.

16. An apparatus according to claim 15, wherein the orifice in both the first nozzle and the second nozzle comprises a central region and a plurality of angularly spaced-apart, outer regions around the periphery of the central region that have a greater radial outward extent than the central region so that fluid flow through the outer regions produces a vortex flow pattern.

17. An apparatus according to claim 13, wherein the apparatus outlet is configured so that the sheared fluid stream which flows through the apparatus outlet exits the apparatus.

* * * * *